US009323223B2

(12) United States Patent
Bucaille

(10) Patent No.: US 9,323,223 B2
(45) Date of Patent: Apr. 26, 2016

(54) TIMEPIECE MOVEMENT WITH A BALANCE AND HAIRSPRING

(71) Applicant: PATEK PHILIPPE SA GENEVE, Geneva (CH)

(72) Inventor: Jean-Luc Bucaille, Beaumont (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 0 days.

(21) Appl. No.: 14/437,065

(22) PCT Filed: Oct. 22, 2013

(86) PCT No.: PCT/IB2013/002355
§ 371 (c)(1),
(2) Date: Apr. 20, 2015

(87) PCT Pub. No.: WO2014/072781
PCT Pub. Date: May 15, 2014

(65) Prior Publication Data

US 2015/0248113 A1 Sep. 3, 2015

(30) Foreign Application Priority Data

Nov. 7, 2012 (CH) ..... 2282/12

(51) Int. Cl.
*G04B 17/06* (2006.01)
*G04B 17/26* (2006.01)

(52) U.S. Cl.
CPC ..... *G04B 17/06* (2013.01); *G04B 17/066* (2013.01); *G04B 17/26* (2013.01)

(58) Field of Classification Search
CPC ..... G04B 17/066; G04B 17/26; G04B 17/06; G04D 3/0041; F16F 1/14
See application file for complete search history.

(56) References Cited

U.S. PATENT DOCUMENTS

| | | | | |
|---|---|---|---|---|
| 7,344,302 | B2 | 3/2008 | Musy et al. | |
| 8,002,460 | B2 * | 8/2011 | Daout et al. | 368/175 |
| 8,348,497 | B2 | 1/2013 | Daout | |
| 2006/0002241 | A1 | 1/2006 | Verardo et al. | |
| 2006/0055097 | A1 * | 3/2006 | Conus et al. | 267/273 |

(Continued)

FOREIGN PATENT DOCUMENTS

| | | | |
|---|---|---|---|
| CH | 327 796 | A | 2/1958 |
| DE | 10 2009 048733 | A1 | 4/2011 |

(Continued)

OTHER PUBLICATIONS

International Search Report, dated May 8, 2014, from corresponding PCT application.

*Primary Examiner* — Sean Kayes
(74) *Attorney, Agent, or Firm* — Young & Thompson

(57) ABSTRACT

The timepiece movement includes a balance-and-hairspring oscillator and an escapement cooperating with the oscillator. The outer turn of the hairspring includes a stiffened portion (9") arranged to at least partially compensate for the variation in the rate of the movement in dependence upon the oscillation amplitude of the balance caused by the escapement. The hairspring further includes at least one of the following features:

a) a distance (R') between the inner end of the hairspring and the centre of rotation of the hairspring lower than 400 μm, b) a Grossmann curve (10) defined by the inner turn of the hairspring, c) a stiffened portion defined by the inner turn of the hairspring.

14 Claims, 12 Drawing Sheets

(56) References Cited * cited by examiner

U.S. PATENT DOCUMENTS

| | | | | |
|---|---|---|---|---|
| 2012/0106303 | A1* | 5/2012 | Von Gunten et al. | 368/175 |
| 2014/0022873 | A1* | 1/2014 | Ching | 368/175 |

FOREIGN PATENT DOCUMENTS

| | | | |
|---|---|---|---|
| EP | 1 445 670 | A1 | 8/2004 |
| EP | 1 473 604 | A1 | 11/2004 |
| EP | 1 612 627 | A1 | 1/2006 |

TIMEPIECE MOVEMENT WITH A BALANCE AND HAIRSPRING

The present invention relates to a timepiece movement comprising a balance-and-hairspring type oscillator and an escapement, more particularly such a movement the isochronism of which is improved. By "isochronism" is meant the variations of the rate in dependence upon the oscillation amplitude of the balance and in dependence upon the position of the watch.

Whilst the balance of a conventional balance-and-hairspring oscillator is oscillating, the hairspring develops eccentrically owing to the fact that its centre of gravity is not on the axis of the oscillator and is moving. This eccentric development generates large return forces between the pivots of the shaft of the oscillator and the bearings in which they rotate, which forces furthermore vary in dependence upon the oscillation amplitude. These return forces disturb the oscillations of the balance and generate variations in the rate of the oscillator in dependence upon the oscillation amplitude. To overcome this problem, the present applicant has proposed, in its patent EP 1473604, a balance-and-hairspring oscillator whose outer turn of the hairspring has a stiffened portion arranged to make the development of the hairspring concentric.

However, it is known that the concentricity of the development of a hairspring is not the only factor which has an influence on isochronism. Mounted in a movement, the oscillator is disturbed by the escapement which causes a rate loss, particularly in the case of a Swiss lever escapement. In fact, during the unlocking phase, the oscillator is subjected to a resistant torque before the line of centres, and this causes a loss. During the impulse phase, the oscillator is subjected to a drive torque firstly before the line of centres, which causes a gain, then after the line of centres, which causes a loss. Overall, the escapement thus produces a rate loss and this disturbance caused by the escapement is greater for small oscillation amplitudes of the balance than it is for large oscillation amplitudes of the balance.

The two above-mentioned phenomena, i.e. eccentric development of the hairspring and rate loss caused by the escapement, are independent or almost independent of the position of the watch. There is added to these two phenomena the effect of gravity, which produces a rate difference between the horizontal position and the vertical position of the watch, and between its different vertical positions.

The present invention aims to further improve the isochronism of a timepiece movement and to this end proposes a timepiece movement comprising a balance-and-hairspring oscillator and an escapement cooperating with the oscillator, the outer turn of the hairspring comprising a stiffened portion, characterised in that the stiffened portion is arranged to at least partially compensate for the variation in the rate of the movement in dependence upon the oscillation amplitude of the balance caused by the escapement, and in that the hairspring further comprises at least one of the following features:

a) a distance between the inner end of the hairspring and the centre of rotation of the hairspring lower than 400 μm, for example equal to about 300 μm, b) a Grossmann curve defined by the inner turn of the hairspring, c) a stiffened portion defined by the inner turn of the hairspring.

It has been surprisingly noted that by experimenting with the arrangement of the stiffened portion of the outer turn of the hairspring, for example its position, extent or thickness, and by adding thereto one of the above features a), b) and c), the overall isochronism of the movement, taking into account the disturbance caused by the non-concentricity of the hairspring, the disturbance caused by the escapement and the disturbance caused by gravity, could be clearly improved with respect to the oscillator described in patent EP 1473604.

Advantageously, the stiffened portion of the outer turn is arranged so that the hairspring produces a rate difference, typically a rate gain, caused by the lack of concentricity of the development of the hairspring of at least 2 s/d, or at least 4 s/d, or even at least 6 s/d, or even at least 8 s/d, at an amplitude of 150° with respect to an amplitude of 300°, at least partially compensating for said rate variation caused by the escapement.

In accordance with a first embodiment, the stiffened portion of the outer turn is closer to the outer end of the hairspring than a theoretical stiffened portion which would make the development of the hairspring substantially perfectly concentric, and the thickness and extent of the stiffened portion may be substantially identical to those of said theoretical stiffened portion.

In accordance with a second embodiment, the stiffened portion of the outer turn is thinner than a theoretical stiffened portion which would make the development of the hairspring substantially perfectly concentric, and the position and extent of the stiffened portion may be substantially identical to those of said theoretical stiffened portion.

In accordance with a third embodiment, the stiffened portion of the outer turn is less extended than a theoretical stiffened portion which would make the development of the hairspring substantially perfectly concentric, and the position and thickness of the stiffened portion may be substantially identical to those of said theoretical stiffened portion.

Other features and advantages of the present invention will become apparent upon reading the following detailed description with reference to the accompanying drawings, in which.

Figure 13:
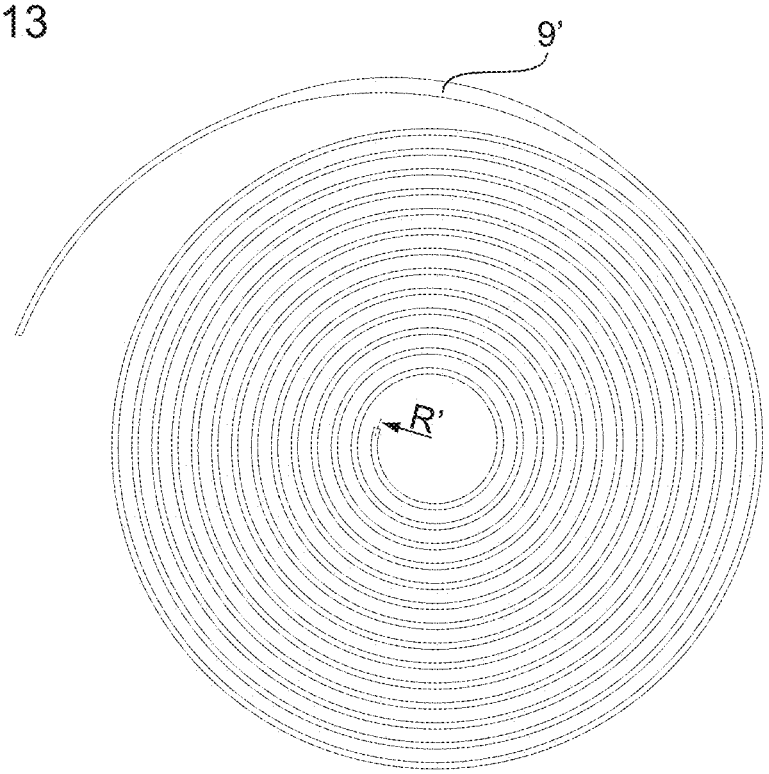
FIG. 13 shows a hairspring having a stiffened outer turn portion and a small-diameter collet, forming an embodiment of the invention.
Figure 15:
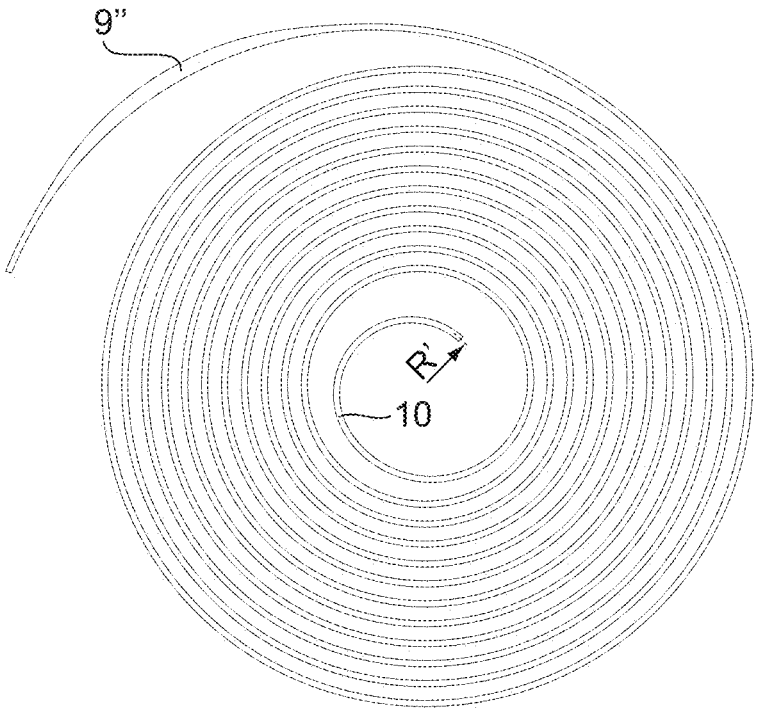
FIG. 15 shows a hairspring having a stiffened outer turn portion, a small-diameter collet and an inner Grossmann curve, forming another embodiment of the invention.
Figure 17:
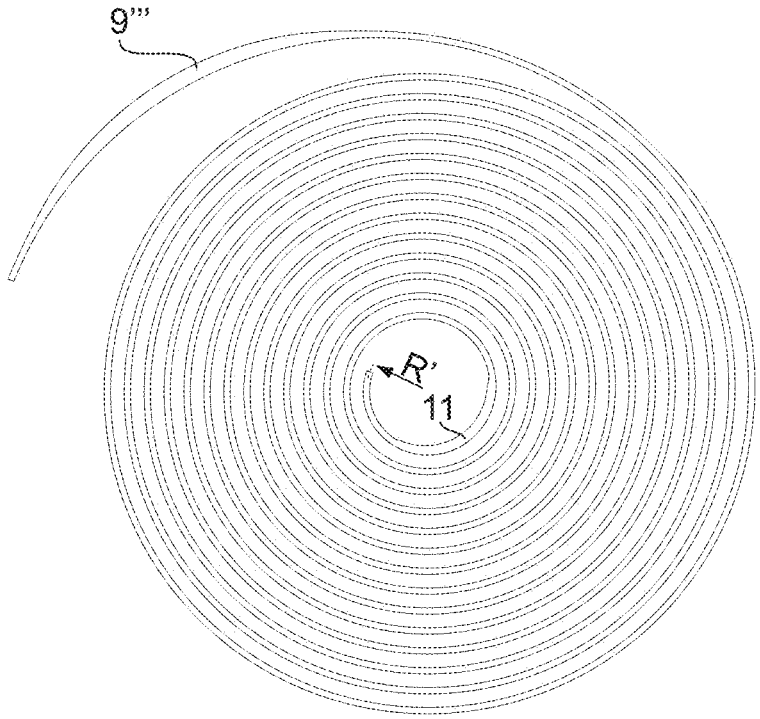
FIG. 17 shows a hairspring having a stiffened outer turn portion, a small-diameter collet and a stiffened inner turn portion, forming still another embodiment of the invention.
Figure 19:
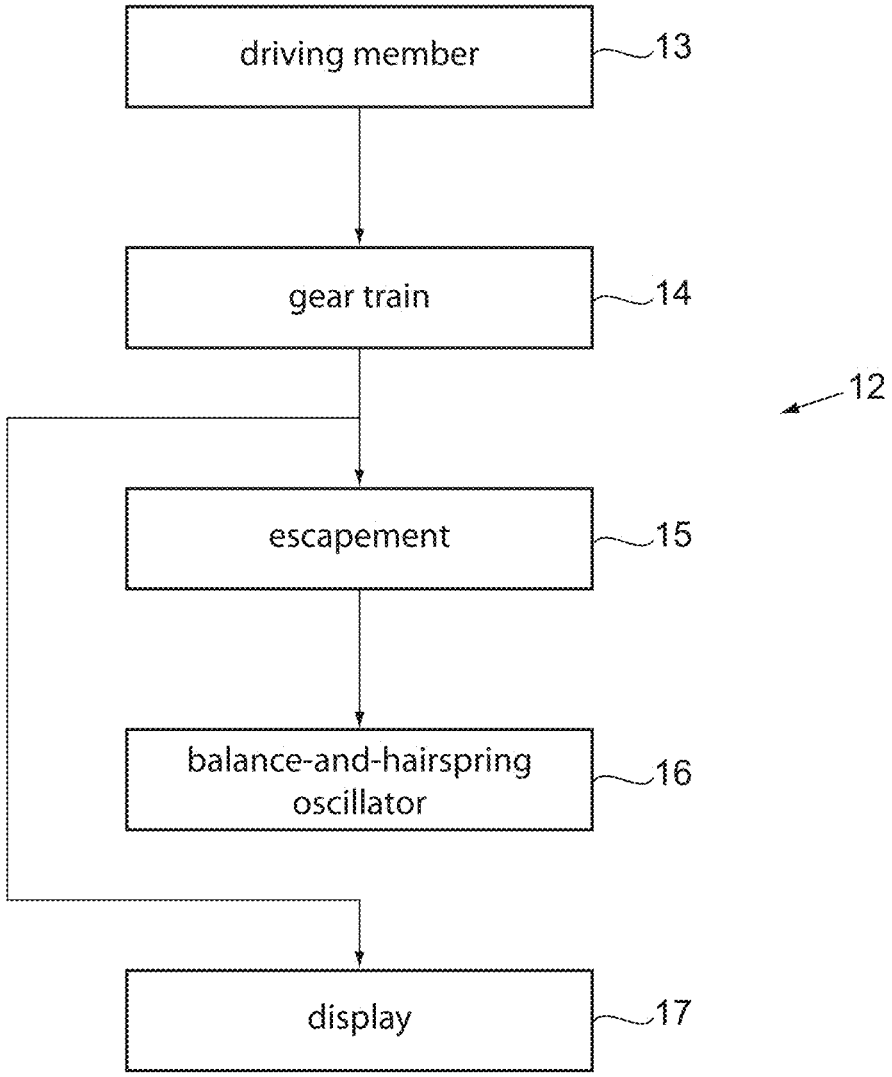

FIG. 19 schematically shows a movement in which a hairspring as shown in FIG. 13, 15 or 17 may be incorporated.

Figure 1:
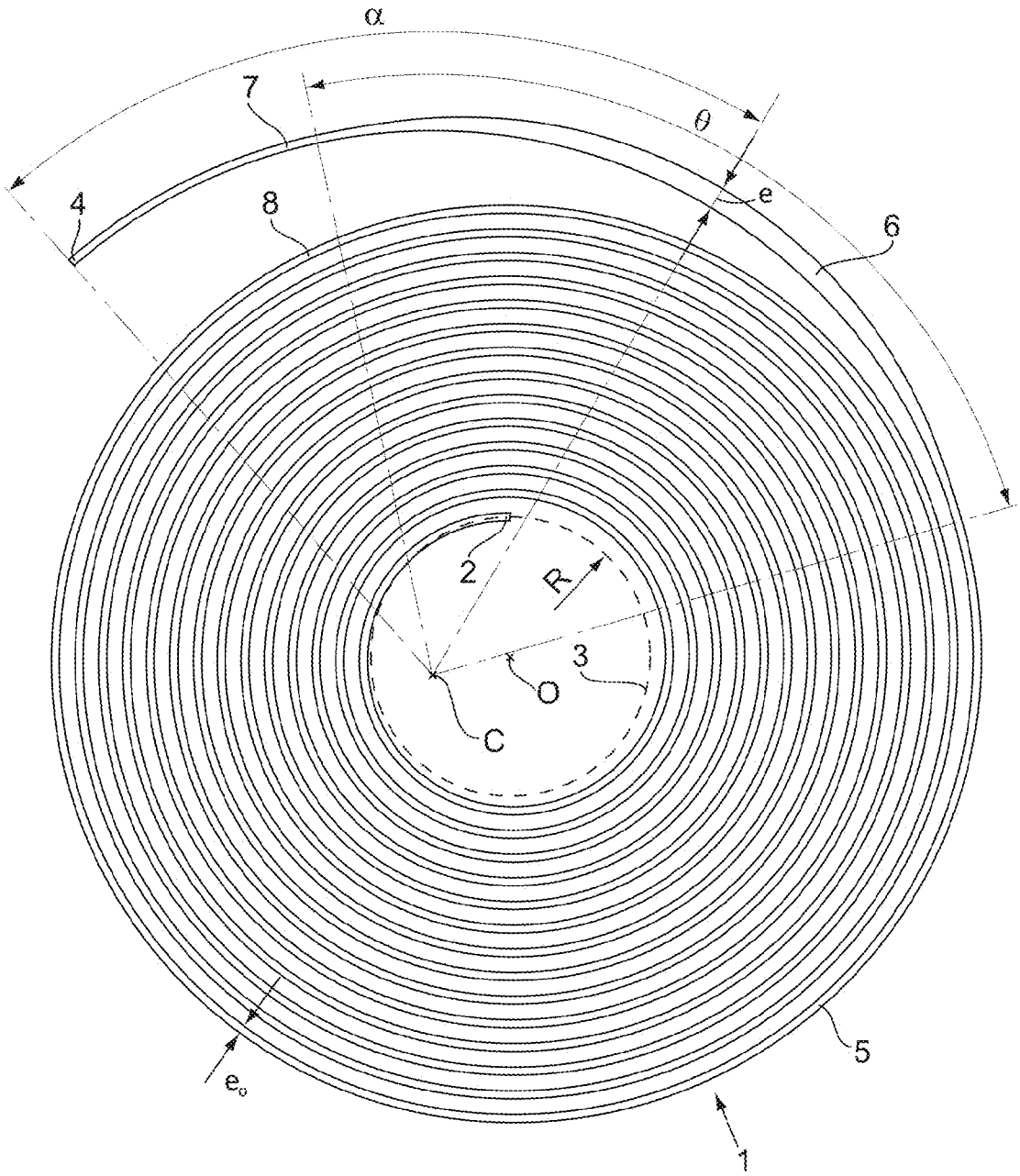
FIG. 1 shows a hairspring having a stiffened outer turn portion in accordance with the prior art, a collet associated with this hairspring being shown schematically by a dashed line.

FIG. 1 shows a flat hairspring of the type described in patent EP 1473604 for a balance-and-hairspring oscillator of a timepiece movement. This hairspring, designated by reference numeral 1, is in the shape of an Archimedean spiral and is fixed by its inner end 2 to a collet 3 mounted on the shaft of the balance and by its outer end 4 to a stud (not shown) mounted on a fixed part of the movement such as the balance-cock. The spring 1-collet 3 assembly can be formed in a single piece, in a crystalline material such as silicon or diamond, by a micro-etching technique. The outer turn 5 of the hairspring 1 has, locally, a portion 6 which has a greater thickness e than the rest of the strip forming the hairspring. This thickness e which can vary along the portion 6 as shown, stiffens the portion 6 and thus makes it substantially inactive as the hairspring develops. The position and extent of the stiffened portion 6 are selected such that the centre of deformation of the hairspring, substantially corresponding to the centre of gravity of the part of the hairspring other than the stiffened portion 6, is substantially coincident with the centre of rotation O of the hairspring and the collet 3, which coincides with the geometric centre of the hairspring. In so doing, the development of the hairspring is concentric or almost concentric. In practice, the stiffened portion 6 ends before the outer end 4 of the hairspring. This outer end 4, more precisely a terminal part 7 of the outer turn 5 including the stiffened portion 6, is radially offset towards the exterior with respect to the course of the Archimedean spiral to ensure that the penultimate turn 8 remains radially free, i.e., it does not contact any element such as the stud, the outer turn or a regulator pin, during operation of the movement. The spacing between the terminal part 7 and the penultimate turn 8 must be greater than that of a conventional hairspring since the penultimate turn 8, owing to the concentric development of the hairspring, moves radially further towards the stud during expansion of the hairspring. The terminal part 7 is in the form of a circular arc with centre C. The angular extent θ of the stiffened portion 6 and its angular position α (defined for example by the angular position of the centre of the stiffened portion 6 with respect to the angular position of the outer end 4) are defined from this centre C. The thickness e is measured along a radius starting from this centre C. In the illustrated example, the hairspring has 14 turns plus a turn portion extending over 30°, the values θ and α are, respectively, 85.9° and 72° and the maximum of the thickness e is 88.7 μm. The thickness $e_0$ of the strip forming the hairspring (measured along a radius starting from the centre of rotation O of the hairspring), except for the stiffened portion 6, is 32.2 μm. The radius R of the collet 3, i.e. the distance between the inner end 2 of the hairspring and the centre of rotation O of the hairspring, is defined as being the radius of the circle (shown in dashed line) of centre O and passing through the middle (at half the thickness $e_0$) of the inner end 2 of the hairspring. In the example shown, this radius R is equal to 565 μm.

Figure 2:
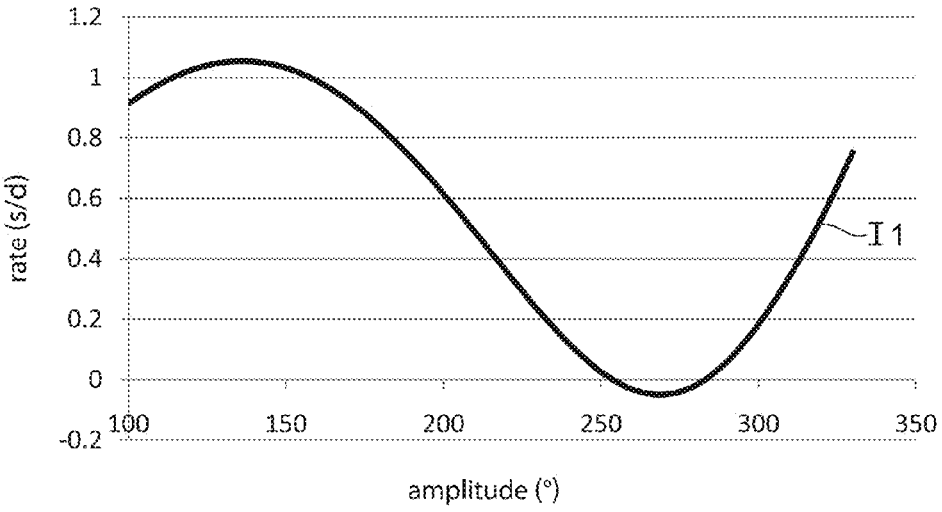
FIG. 2 shows an isochronism curve obtained by digitally simulating the movements of the centre of rotation of the hairspring shown in FIG. 1, the oscillator which this hairspring forms part of being considered to be free, i.e., not subjected to the action of an escapement.

FIG. 2 is an isochronism diagram obtained with the hairspring shown in FIG. 1 by digital simulation. More precisely, the diagram of FIG. 2 is obtained by considering the outer end 4 as being fixed and the shaft on which the collet 3 and the balance are fixed as being free (i.e., not mounted in bearings), by calculating, by finite elements, the movement of the centre of rotation O of the hairspring as the balance oscillates, then by interpolating and integrating the movement curve as a function of the oscillation amplitude. Analytical equations linking the movement of the centre of rotation O of the hairspring to the rate as a function of the oscillation amplitude of the balance are proposed, for example, in the book "Traité de construction horlogère" (Treatise on horological construction) by M. Vermot, P. Bovay, D. Prongué and S. Dordor, published by the Presses polytechniques et universitaires romandes (French-speaking Switzerland polytechnic and university presses), 2011. The x-axis of the diagram of FIG. 2 shows the oscillation amplitude of the balance in degrees with respect to the equilibrium position and the y-axis shows the rate in seconds per day. This diagram thus shows the rate variation of the hairspring caused by the lack of concentricity of the development of the hairspring. This rate variation applies in the same manner in all positions of the watch. As can be seen in FIG. 2, the rate difference between an oscillation amplitude of 150° and an oscillation amplitude of 300° with the hairspring shown in FIG. 1 is in the order of 1 s/d which is excellent. However, this diagram does not take into account the disturbances caused by the escapement nor the disturbances caused by gravity.

Figure 3:
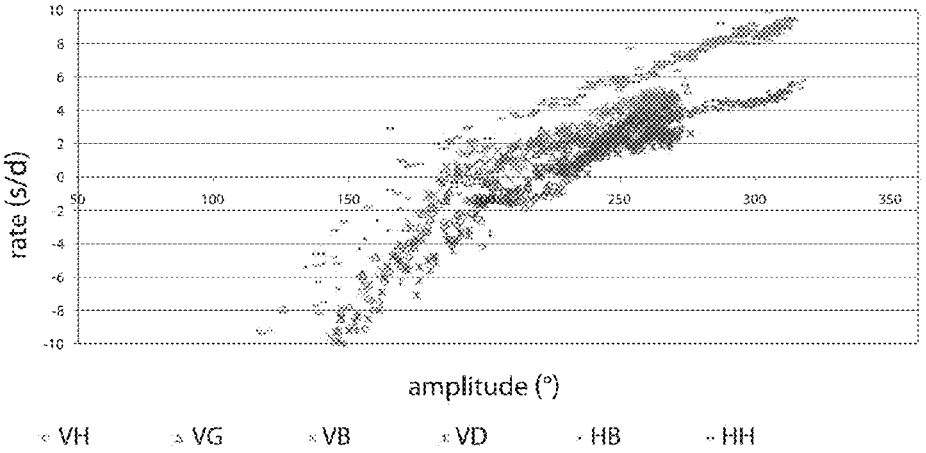
FIG. 3 shows overall isochronism measurement results obtained on a real movement having a hairspring as shown in FIG. 1.

Measurements were taken on twenty movements of identical design, equipped with the hairspring as shown in FIG. 1 and with a conventional Swiss lever escapement. For each movement, in each of six different positions (VH: vertical, high; VG: vertical, left; VB: vertical, low; VD: vertical, right; HB: horizontal, low; and HH: horizontal, high), the rate of the movement was measured during the relaxing of its mainspring and the measurements were plotted on a graph. By way of example, the graph obtained for one of these movements is shown in FIG. 3. The y-axis shows the rate in s/d and the x-axis shows the oscillation amplitude of the balance, which decreases progressively between the completely wound state and the unwound state of the mainspring of the movement owing to the reduction in the force of the mainspring. As can be seen, in all positions of the watch the rate decreases progressively as the oscillation amplitude decreases, and there further exists a rate difference between the different vertical positions. For each position of each movement, a curve was interpolated and the rate difference between the oscillation amplitude of 150° and the oscillation amplitude of 300° was determined. The average of the rate differences for all the positions and all the movements was about 6.7 s/d between said amplitudes. In other words, the rate at 150° was, on average, less than the rate at 300° by about 6.7 s/d. This decrease in the rate, or loss at small amplitudes with respect to large amplitudes, is essentially caused by the escapement.

The present inventor has noted that the decrease in the rate caused by the escapement could, at least in part, be compensated for by modifying the arrangement of the stiffened portion 6, i.e., for example its position α and/or its extent θ and/or its thickness e with respect to the arrangement of FIG. 1 which gives the turns of the hairspring a perfect, or almost perfect, concentricity.

Figure 4:
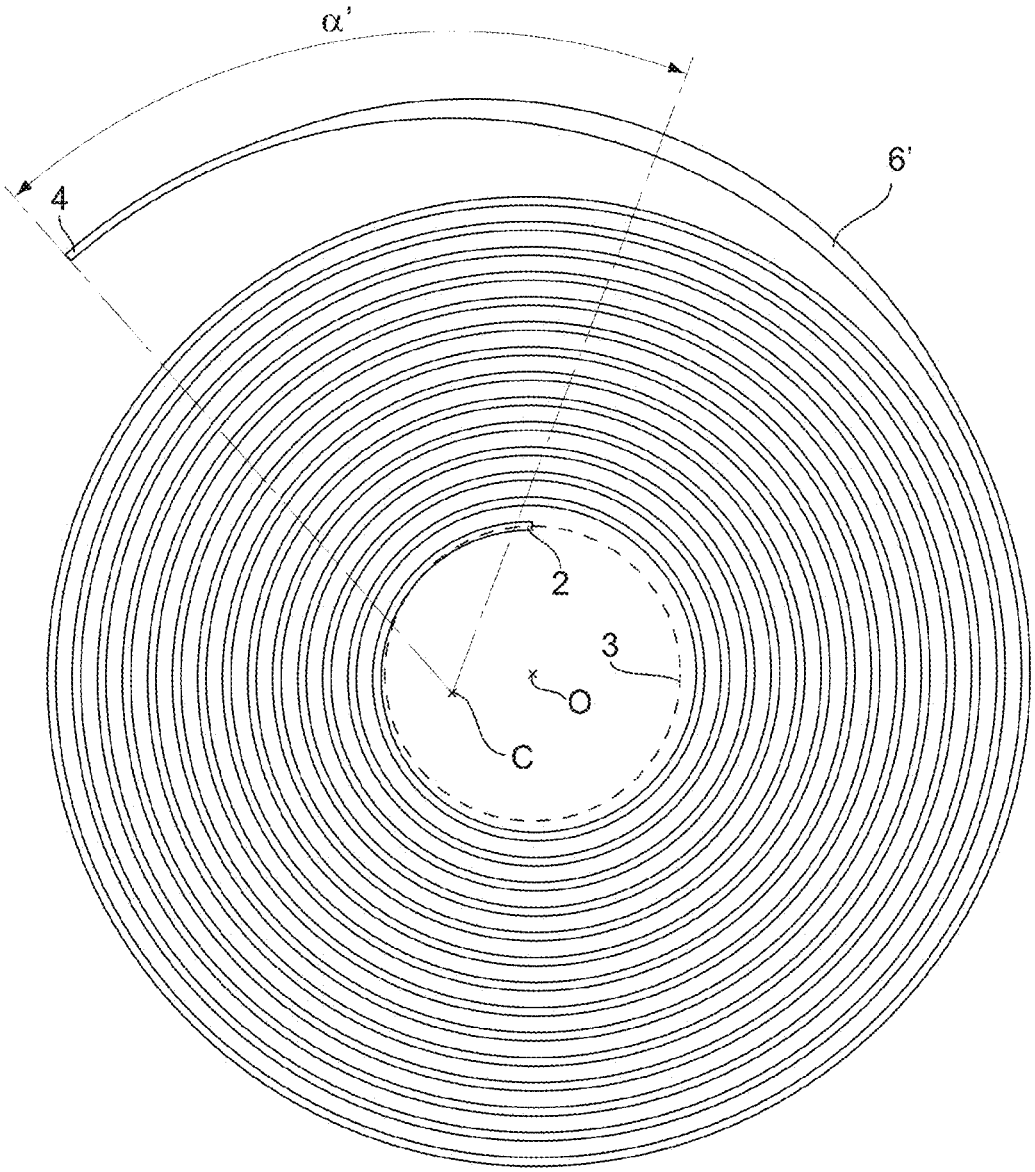
FIG. 4 shows a hairspring of the type as shown in FIG. 1 but whose stiffened outer turn portion has been moved.
Figure 5:
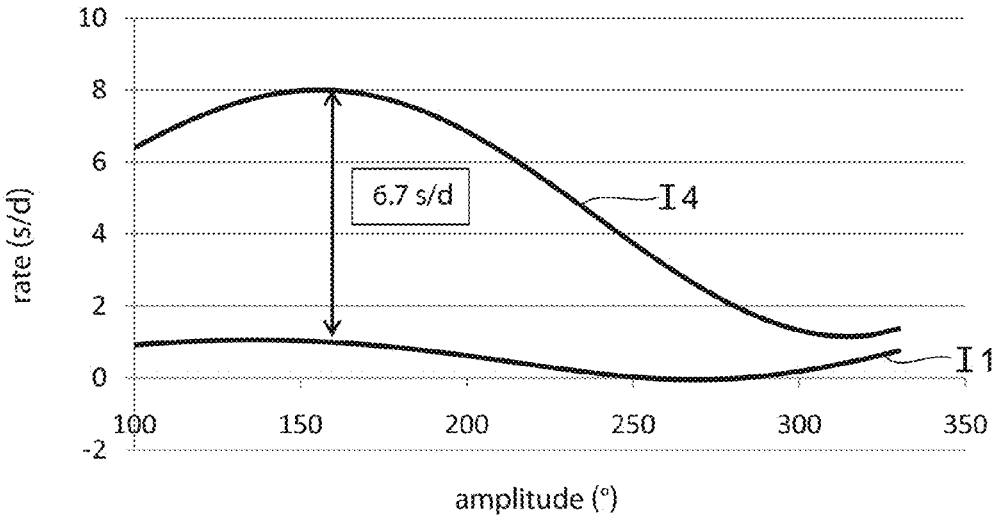
FIG. 5 shows an isochronism curve obtained by digitally simulating the movements of the centre of rotation of the hairspring shown in FIG. 4, the oscillator which this hairspring forms part of being considered to be free, i.e., not subjected to the action of an escapement.
Figure 6:
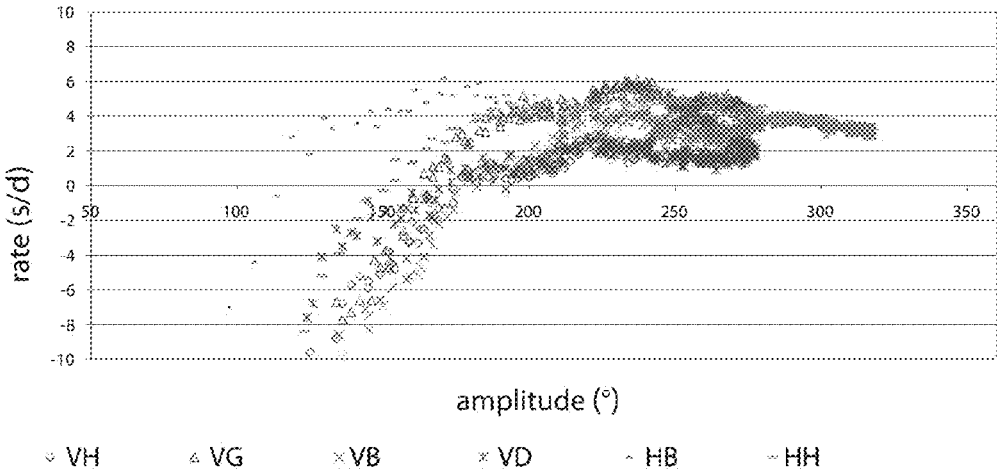
FIG. 6 shows overall isochronism measurement results obtained on a real movement having a hairspring as shown in FIG. 4.

It was discovered in particular that a parameter of the stiffened portion 6 having a particular influence on the isochronism is its position α. By moving the stiffened portion 6 towards the outer end 4 of the hairspring, a rate gain is produced at small oscillation amplitudes with respect to large oscillation amplitudes of the balance. Thus, a rate difference of about 6.7 s/d, but with the opposite sign compared with the average measured rate difference mentioned above, can be obtained between the amplitudes of 150° and 300° by moving the stiffened portion 6 to the position α'=62° and by keeping the other characteristics of the stiffened portion 6 (extent, thickness) constant. The rate variation caused by the escapement can thus be substantially fully compensated for. FIG. 4 shows the new hairspring obtained, with its stiffened outer turn portion designated by reference numeral 6'. The movement of the stiffened portion 6 of course modifies the development of the hairspring which is no longer as concentric. However, on the one hand, this modification is small—the hairspring still develops in a manner more concentric than a conventional hairspring (i.e., a hairspring without a stiffened portion)—and, on the other hand, this modification contributes to improving the overall isochronism of the movement, the lack of concentricity that is created serving to compensate for another shortcoming. The diagram of FIG. 5 shows the isochronism curve I4 of the hairspring shown in FIG. 4, obtained using the same method as for FIG. 2. It can be seen that the increase in the rate between the amplitude of 300° and the amplitude of 150° is substantially linear and with an inverse slope compared with the slope of the rate variation caused by the escapement. The isochronism curve I1 of the hairspring shown in FIG. 1 has also been plotted on this FIG. 5 for comparison purposes. FIG. 6 shows the results of measuring the rate of a movement identical to that on which the measurements in FIG. 3 were taken, but equipped with the hairspring shown in FIG. 4 instead of that in FIG. 1. These results show that the rate variation was significantly reduced by moving the stiffened portion to the position α', in particular in the range of amplitudes from 180° to 300° where the general shape of the graph is flat.

Figure 7:
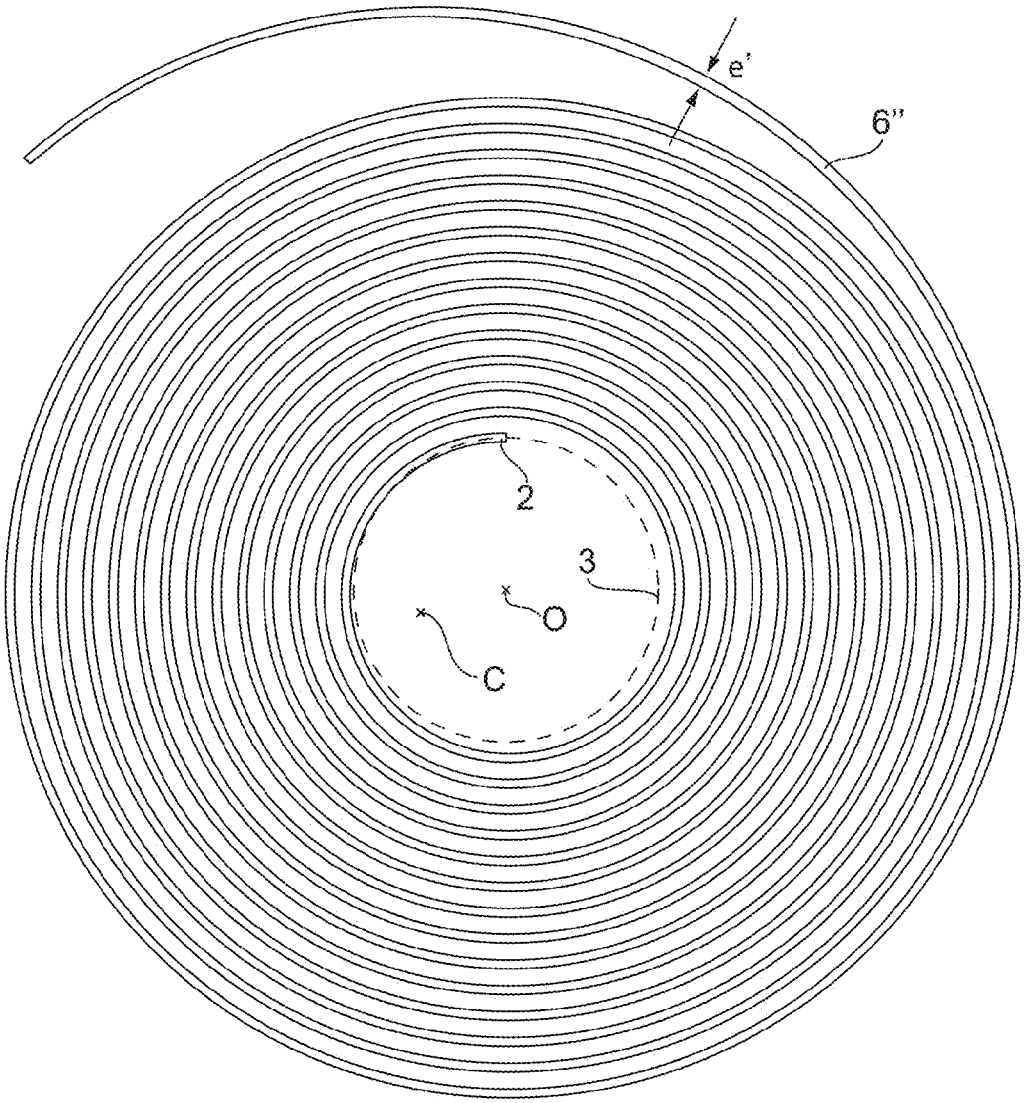
FIG. 7 shows a hairspring of the type as shown in FIG. 1 but whose thickness of the stiffened outer turn portion has been modified.
Figure 8:
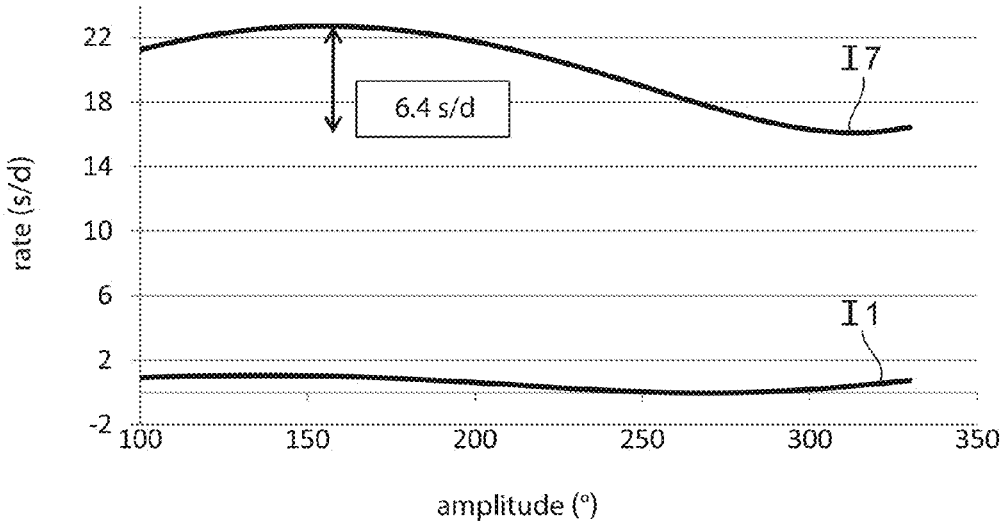
FIG. 8 shows an isochronism curve obtained by digitally simulating the movements of the centre of rotation of the hairspring shown in FIG. 7, the oscillator which this hairspring forms part of being considered to be free, i.e., not subjected to the action of an escapement.

Another parameter of the stiffened portion 6 having an influence on the isochronism is its thickness e. By decreasing the thickness e, a rate gain is produced at small oscillation amplitudes with respect to large oscillation amplitudes of the balance. Thus, for example, a rate difference of about 6.4 s/d, but with the opposite sign compared with the average measured rate difference mentioned in relation to FIG. 3, can be obtained between the amplitudes of 150° and 300° by decreasing the maximum of the thickness e of the stiffened portion 6 (and the remaining thickness proportionally) to the value e'=44.2 μm and by keeping the other characteristics of the stiffened portion (position, extent) constant. FIG. 7 shows the hairspring obtained, with its stiffened outer turn portion designated by reference numeral 6", and FIG. 8 shows the isochronism curve I7 corresponding to such a hairspring.

Figure 10:
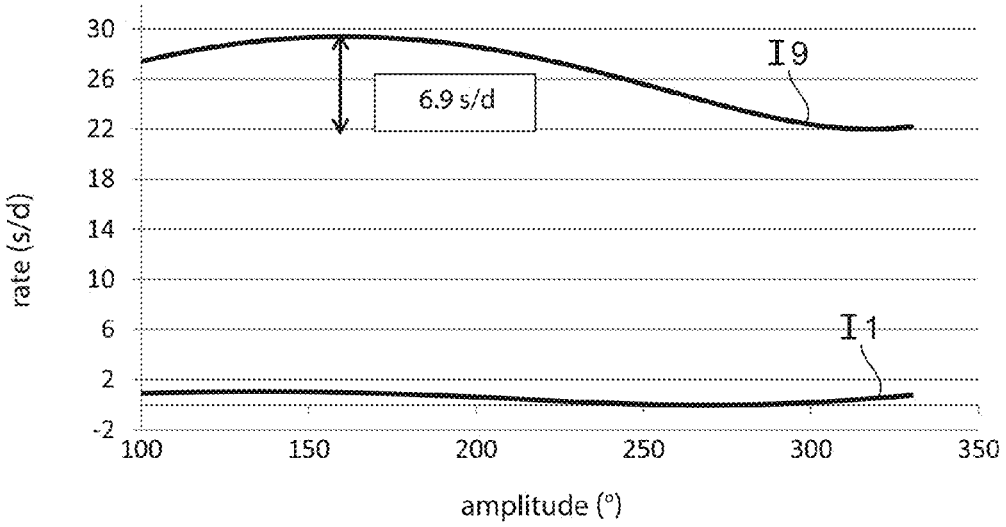
FIG. 10 shows an isochronism curve obtained by digitally simulating the movements of the centre of rotation of the hairspring shown in FIG. 9, the oscillator which this hairspring forms part of being considered to be free, i.e., not subjected to the action of an escapement.
Figure 9:
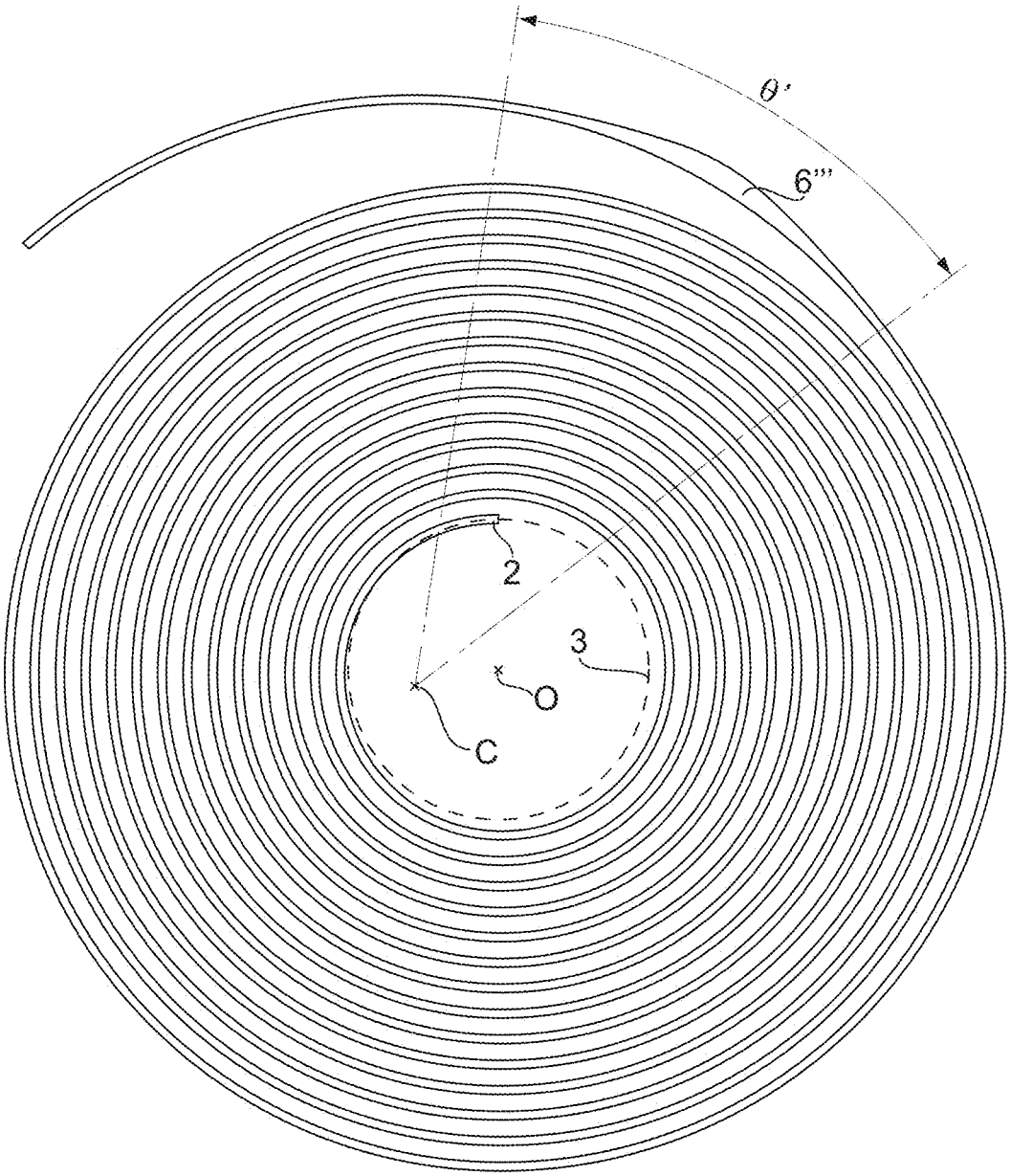
FIG. 9 shows a hairspring of the type as shown in FIG. 1 but whose angular extent of the stiffened outer turn portion has been modified.

Still another parameter of the stiffened portion having an influence on the isochronism is its extent θ. By decreasing the extent θ, a rate gain is produced at small oscillation amplitudes with respect to large oscillation amplitudes of the balance. Thus, for example, a rate difference of about 6.9 s/d, but with the opposite sign compared with the average measured rate difference mentioned in relation to FIG. 3, can be obtained between the amplitudes of 150° and 300° by decreasing the angular extent θ of the stiffened portion to the value θ'=43.0° and by keeping the other characteristics of the stiffened portion (position, thickness or maximum of the thickness) constant. FIG. 9 shows the hairspring obtained, with its stiffened outer turn portion designated by reference numeral 6''', and FIG. 10 shows the isochronism curve I9 corresponding to such a hairspring.

In variations, the principles exposed above could, of course, be combined, i.e., at least two of the parameters α, e and θ could be modified.

Figure 11:
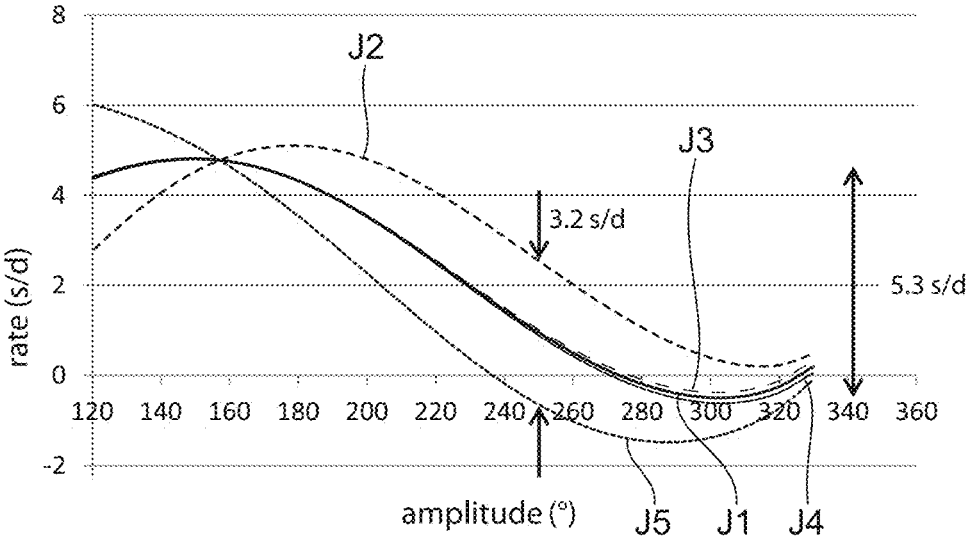
FIG. 11 shows isochronism curves corresponding to different horizontal and vertical positions of a hairspring having a stiffened outer turn portion.

Referring again to FIG. 6, it can be noted that the modification brought to the stiffened portion has the effect of compensating for the rate variation caused by the escapement, but that it does not have any effect, or has little effect, on the rate difference between the different vertical positions of the watch. This applies irrespective of which parameter(s) α, e, θ is(are) chosen to be modified. FIG. 11 shows isochronism curves, designated by J1 to J5, of a hairspring the outer turn of which has a stiffened portion arranged to compensate for the rate variation caused by the escapement, as described above. The curve J1 shows the isochronism of the hairspring in horizontal position, i.e. the rate variations caused by the non-concentric development of the hairspring, and is obtained in the same manner as the curves in FIGS. 2, 5, 8 and 10. As can be seen, the stiffened portion of the outer turn of the hairspring is arranged so that the hairspring produces a rate gain of 5.3 s/d at the amplitude of 150° with respect to the amplitude of 300°. The curves J2 to J5 show the isochronism of the hairspring in the four vertical positions VG, VH, VB and VD respectively, and are obtained by taking into account both the non-concentric development of the hairspring and the effect of gravity, in other words by adding the rate variations caused by the non-concentric development of the hairspring and by the gravity. In order to determine the rate variation caused by gravity, in a given vertical position, one can calculate by finite elements the movement of the centre of gravity of the hairspring under the effect of the oscillations of the hairspring (the centre of rotation of the hairspring being fixed), then use analytical equations linking this movement and the position of the hairspring to the rate as a function of amplitude. Such analytical equations are proposed, for example, in the aforementioned book "Traité de construction horlogère" (Treatise on horological construction). The static effect of subsidence of the turns caused by gravity is disregarded in the present invention, as is the effect of the unbalance of the balance, which unbalance may be minimised by known means.

It can be noted in FIG. 11 that the rate difference between the vertical positions is of 3.2 s/d at an oscillation amplitude of the balance of 250°. In order to decrease this rate difference, the present invention proposes to modify the inner portion of the hairspring, namely the distance between the inner end of the hairspring and the centre of rotation of the hairspring and/or the shape of the inner turn.

Figure 12:
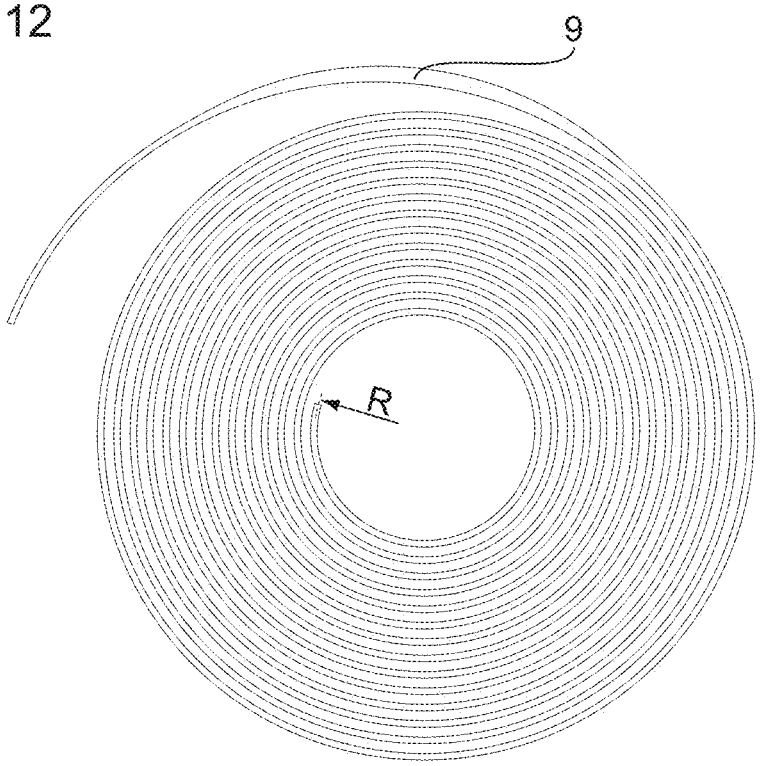
FIG. 12 shows the hairspring the isochronism curves of which are shown in FIG. 11.
Figure 14:
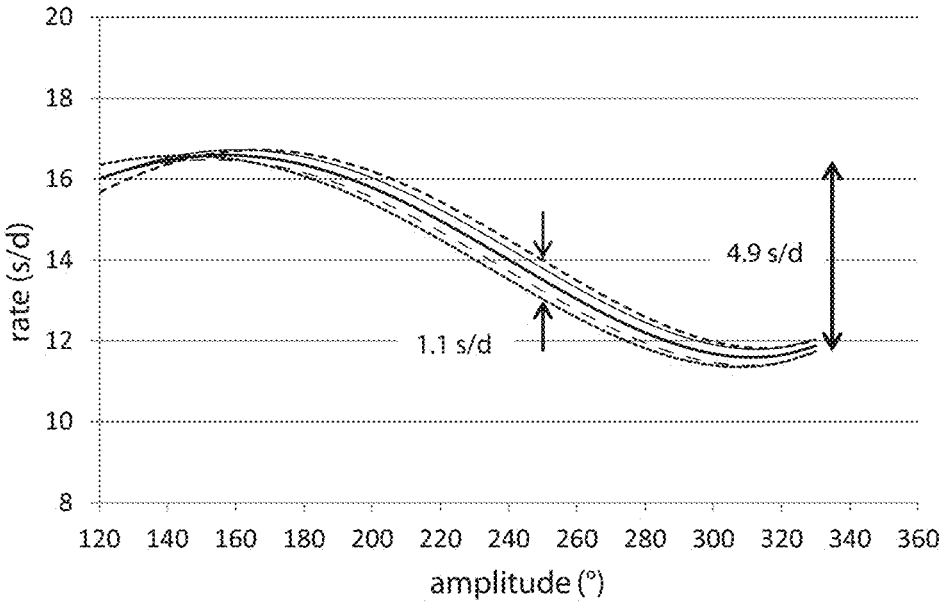
FIG. 14 shows isochronism curves corresponding to different horizontal and vertical positions of the hairspring shown in FIG. 13.

The hairspring corresponding to the isochronism curves J1 to J5 illustrated in FIG. 11 is shown in FIG. 12. It comprises 14 turns. The angular extent and the angular position of its stiffened portion 9 (measured in the same manner as for the hairsprings in FIGS. 1, 4, 7 and 9) are of 60° and 75° respectively. The radius R of its collet, i.e. the distance between the inner end of the hairspring and the centre of rotation of the said hairspring, measured in the same manner as in FIG. 1, is equal to 565 μm. It has been noted that by decreasing the radius R to a value R', the rate difference between the vertical positions is reduced. The radius R' is advantageously chosen to be lower than 400 μm. FIG. 14 shows the isochronism curves of a hairspring (illustrated in FIG. 13) that is similar to the one in FIG. 12 but has a collet radius R' equal to 300 μm (and a pitch and a turn thickness adapted accordingly). As is apparent from FIG. 14, the rate difference between the vertical positions at an amplitude of 250° is of 1.1 s/d, a value that is much lower than the 3.2 s/d of the hairspring of FIG. 12. However, to obtain a rate gain between the oscillation amplitudes of 150° and of 300° that is similar to the one of the hairspring of FIG. 12, the stiffened portion, designated by 9', must be adapted. Thus, in FIG. 13, the angular extent and the angular position of the stiffened portion 9' are of 50° and of 75° respectively.

Figure 16:
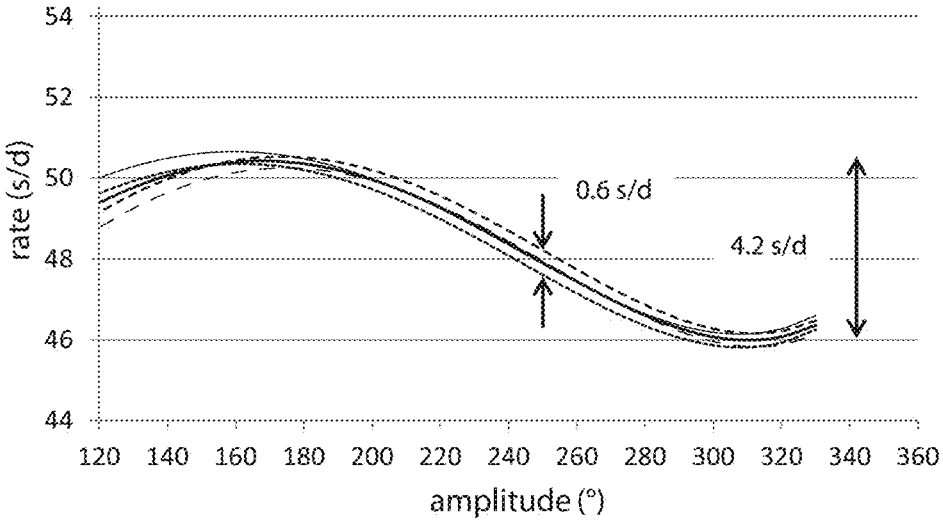
FIG. 16 shows isochronism curves corresponding to different horizontal and vertical positions of the hairspring shown in FIG. 15.
Figure 18:
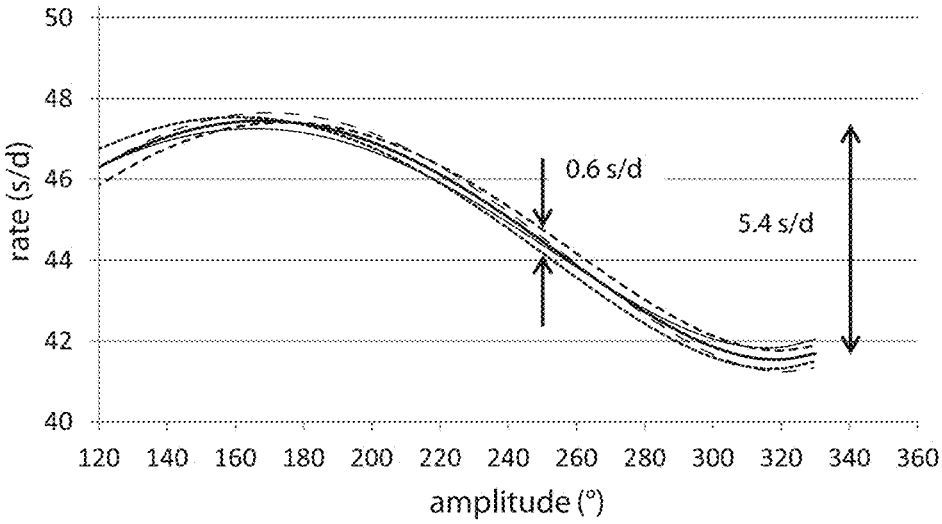
FIG. 18 shows isochronism curves corresponding to different horizontal and vertical positions of the hairspring shown in FIG. 17.

Another manner of decreasing the rate difference between the vertical positions is to shape the inner turn of the hairspring according to a Grossmann curve or to stiffen an inner turn portion. Such a modification of the inner turn may even be combined with the decrease of the radius R of the collet to still further reduce the rate difference. Thus, FIG. 15 shows a hairspring the collet radius R' of which is equal to 300 μm and the inner turn 10 of which is shaped as a Grossmann curve. In FIG. 16, it can be seen that the rate difference between the vertical positions for this hairspring is of only 0.6 s/d at an oscillation amplitude of 250°. In a similar manner, a hairspring having a stiffened portion 11 on the inner turn as shown in FIG. 17 (the inner stiffened portion 11 having, like the outer stiffened portion 9', a larger thickness than the remainder of the turns) will enable obtaining a rate difference between the vertical positions of 0.6 s/d at an oscillation amplitude of 250° (FIG. 18). In the case of the hairspring of FIG. 15, the stiffened portion 9" of the outer turn is arranged so that the hairspring produces a rate gain caused by the lack of concentricity of the development of the hairspring of 4.2 s/d between the amplitudes of 150° and 300°, to compensate for a rate loss caused by the escapement of the same order of magnitude. In the case of the hairspring of FIG. 17, the stiffened portion 9''' of the outer turn is arranged to that the hairspring produces a rate gain caused by the lack of concentricity of the development of the hairspring of 5.4 s/d between the amplitudes of 150° and 300°, to compensate for a rate loss caused by the escapement of the same order of magnitude.

Although the combination of a Grossmann curve or of a stiffened inner turn portion with a small collet radius R' is particularly advantageous, it will be noted that the Grossmann curve 10 or the stiffened inner turn portion 11 could also be used with a collet of larger radius R. One could also combine a small collet radius R', a Grossmann curve and a stiffened inner turn portion. In all cases, the stiffened outer turn portion can be arranged according to any one of the principles exposed in relation to FIGS. 4, 7 and 9 or according to a combination of these principles. Moreover, it is evident that the said principles could be applied to a movement the escapement of which would produce a rate gain instead of a rate loss. Thus, for example, to compensate for such a rate gain the stiffened outer turn portion could be moved away from the outer end of the hairspring or the angular extent of the stiffened outer turn portion could be increased.

The hairsprings described above are each intended to form part of an oscillator of a timepiece movement of the type of the movement 12 shown in the form of a block-diagram in FIG. 19. Besides the oscillator, designated by 16, the movement 12 comprises, in a conventional manner, a drive member 13 such as a barrel, a gear train 14, an escapement 15 and a display 17.

The invention claimed is:

1. Timepiece movement comprising a balance-and-hairspring oscillator and an escapement cooperating with the oscillator, the outer turn of the hairspring comprising a stiffened portion, wherein the stiffened portion is arranged so that the hairspring produces a rate difference caused by the lack of concentricity of the development of the hairspring of at least 2 seconds/day at an amplitude of 150° with respect to an amplitude of 300° to at least partially compensate for the variation in the rate of the movement in dependence upon the oscillation amplitude of the balance caused by the escapement, and the hairspring further comprises at least one of the following features:

a) a distance (R') between the inner end of the hairspring and the centre of rotation of the hairspring lower than 400 μm, b) a Grossmann curve defined by the inner turn of the hairspring, and c) a stiffened portion defined by the inner turn of the hairspring.

2. Timepiece movement as claimed in claim 1, wherein the stiffened portion of the outer turn is arranged so that the hairspring produces a rate difference caused by the lack of concentricity of the development of the hairspring of at least 4 seconds/day at an amplitude of 150° with respect to an amplitude of 300° , at least partially compensating for said rate variation caused by the escapement.

3. Timepiece movement as claimed in claim 2, wherein the stiffened portion of the outer turn is arranged so that the hairspring produces a rate difference caused by the lack of concentricity of the development of the hairspring of at least 6 seconds/day at an amplitude of 150° with respect to an amplitude of 300° , at least partially compensating for said rate variation caused by the escapement.

4. Timepiece movement as claimed in claim 3, wherein the stiffened portion of the outer turn is arranged so that the hairspring produces a rate difference caused by the lack of concentricity of the development of the hairspring of at least 8 seconds/day at an amplitude of 150° with respect to an amplitude of 300° , at least partially compensating for said rate variation caused by the escapement.

5. Timepiece movement according to claim 1, wherein said rate difference is a rate gain.

6. Timepiece movement as claimed in claim 1, wherein the stiffened portion of the outer turn is closer to the outer end of the hairspring than a theoretical stiffened portion which would make the development of the hairspring concentric, wherein the thickness (e) and extent (θ) of the stiffened portion of the outer turn are substantially identical to those of said theoretical stiffened portion.

7. Timepiece movement as claimed in claim 1, wherein the stiffened portion (6") of the outer turn is thinner than a theoretical stiffened portion (6) which would make the development of the hairspring concentric, wherein the position (α) and extent (θ) of the stiffened portion of the outer turn are substantially identical to those of said theoretical stiffened portion.

8. Timepiece movement as claimed in claim 1, wherein the stiffened portion of the outer turn is less extended than a theoretical stiffened portion which would make the development of the hairspring concentric, wherein the position (α)

and thickness (e) of the stiffened portion of the outer turn are substantially identical to those of said theoretical stiffened portion.

9. Timepiece movement according to claim 1, wherein the hairspring comprises the feature a).

10. Timepiece movement according to claim 9, wherein said distance (R') is of about 300 μm.

11. Timepiece movement according to claim 10, wherein the hairspring further comprises the feature c).

12. Timepiece movement according to claim 9, wherein the hairspring further comprises the feature b).

13. Timepiece movement according to claim 12, wherein the hairspring further comprises the feature c).

14. Timepiece movement according to claim 9, wherein the hairspring further comprises the feature c).

* * * * *